United States Patent [19]

Patel et al.

[11] Patent Number: 4,551,892

[45] Date of Patent: Nov. 12, 1985

[54] METHODS FOR PREPARING WARP KNITTED FABRICS

[75] Inventors: Shantilal G. Patel, Clifton, N.J.; William D. Bell, Warwick, N.Y.

[73] Assignee: International Playtex, Inc., Stamford, Conn.

[21] Appl. No.: 717,591

[22] Filed: Mar. 29, 1985

Related U.S. Application Data

[60] Continuation of Ser. No. 577,187, Feb. 6, 1984, abandoned, which is a division of Ser. No. 316,799, Oct. 30, 1981, Pat. No. 4,487,040.

[51] Int. Cl.[4] ..... D04B 21/00

[52] U.S. Cl. ..... 28/166

[58] Field of Search ..... 28/166, 179, 180, 181; 57/200, 255, 257, 258; 66/125 A, 176, 195, 202

[56] References Cited

U.S. PATENT DOCUMENTS

| | | | |
|---|---|---|---|
| 2,664,409 | 12/1953 | Aickin et al. | 66/125 A X |
| 3,279,163 | 10/1966 | Lulay et al. . | |
| 3,413,825 | 12/1968 | Winch . | |
| 3,435,608 | 4/1969 | Stanley . | |
| 3,442,099 | 5/1969 | Auville et al. . | |
| 3,492,195 | 1/1970 | Spangler et al. | 57/200 X |
| 3,626,441 | 12/1971 | Freed . | |
| 3,738,902 | 6/1973 | Turner . | |
| 3,981,310 | 9/1976 | Donaghy . | |
| 4,080,777 | 3/1978 | Griset, Jr. . | |
| 4,098,097 | 7/1978 | Langanke et al. . | |

FOREIGN PATENT DOCUMENTS

| | | |
|---|---|---|
| 2744866 | 11/1978 | Fed. Rep. of Germany . |
| 53-103043 | 9/1978 | Japan . |
| 1581265 | 12/1980 | United Kingdom . |

OTHER PUBLICATIONS

*Knitting Times*, Feb. 15, 1971, vol. 40, No. 7, pp. 39–48.

*Man-Made Textile Encyclopedia*, Interscience Publishers, New York, New York, 1959, pp. 73–76.

Merrill, G. R., *Cotton Ring Spinning*, Mass., G. R. Merrill, 1959, pp. 88, 90.

*Textured Yarn Technology*, 1, vol. 1, Monsanto, 1967, pp. 374–381.

Reisfeld, A., *Warp Knit Engineering*, N.Y. National Knitted Outerwear Association, 1966, pp. 50–61, 70–83, 462, 463.

*Primary Examiner*—Robert R. Mackey

*Attorney, Agent, or Firm*—Stewart J. Fried; Charles N. J. Ruggiero

[57] ABSTRACT

A method of preparing a spun yarn for use in a fine gauge wrap knitting machine having the following steps: (a) spinning polyester stable fibers having a denier of less than 2 and having a staple length in a range of about 1.5 to about 2.0 inches, (b) twisting the yarn in a range of 24 to 36 twists per inch, (c) waxing and steaming the yarn, and (d) warping the yarn in an environment having a humidity in a range of 65% to 70% and having a temperature in a range of 70° to 72° Fahrenheit.

4 Claims, 2 Drawing Figures

METHODS FOR PREPARING WARP KNITTED FABRICS

This application is a continuation of application Ser. No. 577,187 filed Feb. 6, 1984, now abandoned, which in turn is a division of application Ser. No. 316,799, filed on Oct. 30, 1981, now U.S. Pat. No. 4,487,040, which issued on Dec. 11, 1984.

BACKGROUND OF THE INVENTION

The present invention relates generally to warp knitted fabrics and, more specifically, to a warp knitted fabric of an improved hand. In the brassiere industry, the brassiere cup has gone from being made by cutting planar fabrics, for example, into a plurality of appropriate pieces which are sewn together to form a three dimensional bra cup to molded cups. Although providing shape retention and support after wearing and washing, the cotton sewn bra cups have an undesirable ridge or seam line.

Early attempts to produce molded bra cups typically involved molding nylon fabrics. Because of the temperature limitations, later developments included woven polyester fabrics. Problems in molding a uniform bra cup using woven polyester were encountered and it was suggested to use knitted rather than woven polyester fabrics. Initially, multi-filament polyester yarns were used followed by mono-filament yarns. Although mono-filament yarns provided a more stable fabric, they were coarse or had a rough hand.

To solve the problems of the prior art, U.S. Pat. No. 3,981,310 to Donaghy proposes a unique warp knit construction using continuous filament polyester yarns. Although this structure is an improvement over prior art fabrics capable of being molded an retaining their shape and support after a plurality of washing and wearing, there is still a desire to produce a moldable fabric to be used in a bra cup and other intimate articles of clothing which has a hand closer to that of natural fibers such as cotton.

The use of texturized or spun-staple polyester fibers to improve the hand is well-known. The problem of warp knitting on small gauge machines, for example, 28 gauge tricot knitting machines, is described in U.S. Pat. No. 3,442,099 to Auville et al. Because of the space limitation of the 28 gauge tricot knitting machine and physical size of texturized yarn, Auville et al suggests unique knitting construction of texturized continuous filament yarns having a denier less than 10 each per filament and the total denier of at least 150 by alternating between the first and second bar to form alternate courses. It has been suggested by Turner in U.S. Pat. No. 3,738,902 to prepare a warp knitted fabric containing a 150/34 texturized polyester filament in the face and 150/25/40 rayon filament in the back or 22/1 spun polyester in the face and 20/1 polyester-rayon spun fiber in the back. These particular size spun polyester yarns are not capable of being knitted on a 28 gauge tricot machine and, thus, a moldable fabric capable or producing a desired hand for use in intimate garments could not be produced.

Thus, there exists the need for a moldable polyester fabric having improved hand.

SUMMARY OF THE INVENTION

An object of the present invention is to provide a moldable polyester fabric of improved hand.

Another object of the present invention is to provide a method of forming moldable polyester fabric on a 28 gauge tricot warp knitting machine.

Another object of the present invention is to provide a spun staple polyester yarn capable of being used on a 28 gauge tricot warp knitting machine.

These and other objects of the present invention are achieved by forming a moldable fabric having an improved hand from spun yarns of polyester staples warp knitted on a 28 needles per inch warp knitting machine. The size of the yarn should be no coarser than 60 single spun count for a tricot or equivalent knitting machine and no coarser than 50 single spun count for a Raschel or equivalent knitting machine. The yarn should be formed from staples having a length in the range of about 1.5 to 2 inches and a twist in the range of about 24 to about 36 twists per inch. The denier of the individual staples should be less than 2. The yarn should be waxed and steamed. The warping of the yarn should be in a environment having a humidity in the range of about 65 to about 70% and a temperature in the range of 70° to 72° Fahrenheit.

Other objects, advantages and novel features of the present invention will become apparent from the accompanying drawing and the following detailed description of the invention.

DETAILED DESCRIPTION OF THE PREFERRED EMBODIMENTS

As discussed above, there is a continuing effort, especially in the intimate apparel industry, to provide a moldable material with increased hand while maintaining the structural support characteristics and the ability to be continuously washed. U.S. Pat. No. 3,981,310 to Donaghy describes a knitting pattern on a warp knit machine which accomplish these objectives. To further improve the hand, the invention is directed to a spun yarn of polyester staples to be used on the warp knitting machine. Although it has been suggested, as discussed above, to use polyester spun yarn on a warping equipment, the specific size of the yarn has not permitted the use on a 28 gauge tricot warp knitting machine. Spun yarn from polyester staples by definition do not have the uniform thickness and produce a lot of fly and other debris. Thus, before this invention, the use of spun polyester yarn in such a fine gauge machine has not been considered. In order to achieve this end, a specially prepared yarn is processed through special steps and under special environments.

The yarn for use on a 28 gauge tricot machine has been found to have a size no coarser than 60/1 single spun count whereas a gauge Raschel machine (56 needles per 2 inch Raschel is equivalent to a 28 gauge tricot machine) can use spun yarns having a size no coarser than 50/1 single spun count. These parameters apply to other machines equivalent to the tricot and the Raschel machine. It should be noted that the size of the yarn increases for small counts and therefore the size of the yarn, not the count, should be no larger than the numbers previously mentioned. This specific size yarn allows them to be used on 28 gauge tricot machine to produce the desired fabric at a commercial rate of operation. It should be noted that the hand is a function of the 28 gauge tricot warp knit as well as the yarn and, thus, the yarn is especially designed for the 28 gauge tricot warp knitting machines. The spun yarn should be made from staples having a size per staple less than 2 deniers and a staple length in the range of about 1.5 to about 2 inches. With length shorter than about 1.5 inches, the yarn will have a decreased strength unless it is highly twisted which will reduce the hand. With staple lengths much larger than about 2 inches, the texture of the spun yarn will approach that of a continuous filament yarn and, thus, there will be no gain in the hand. The yarn is made on ring spinning equipment which is presently available in the textile industry.

In order to minimize the slubs and fly from the surface of the yarn, proper twist in the yarn is required. It should be noted that too much twist will reduce the hand and, thus, a optimum range must be defined. The preferred range of twist is 24 to 36 twists per inch with the range of 3.25 to 4.5 twist multipliers. In order to achieve smoothness and uniformity in the yarn as well as reducing slubs and fly, the yarn is waxed and steamed.

Figure 2:
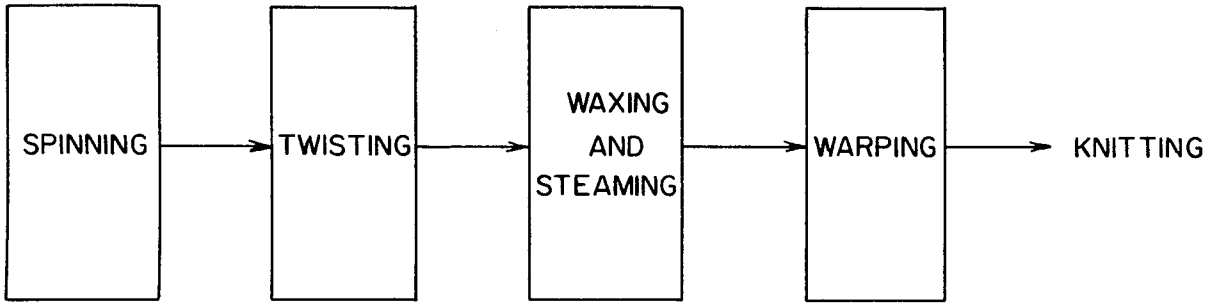
FIG. 2 is a flow chart of the steps of the method of the present invention.

As shown in FIG. 2, the next step in preparation of the yarn for knitting is warping. The warping operation should be carried out in such a way as to not increase the slubs or fly on the surface of the yarn. To achieve this end, the atmospheric conditions for the warping must be closely controlled. The humidity should be in the 65 to 70% range and the temperature between 70° to 72° Fahrenheit. The warping equipment should include friction posts with disc tension on the creel and a split reed. The warping machine must be equipped with an eyeboard wherein the eyes have a minimum spacing of 0.031 inch. The minimum spacing prevents the interaction, tangling and other undesirable effects when using a spun staple yarn. By way of example, yarn has been beamed at about 300 to about 325 yards per minute with about 6 to about 8 grams per end tension.

The knitting construction for the spun stapled yarn on a 28 gauge tricot machine can be accomplished using the pattern described in U.S. Pat. No. 3,981,310 to Donaghy which is incorporated herein by reference for its warp knitting structure. This fabric may be composed of the spun staple yarn on all bars or the back bars may include continuous filament polyester or Spandex or other moldable or stretch yarns. Patterns may be formed using 2, 3 or 4 bar warp knitting equipment. As with the warping, it is suggested that the environment be controlled relative to humidity and temperature to reduce the amount of fly and slubs.

Because the spun staple yarn does have fly, the back bars should be covered with a plate preferably plexiglass so that any lint accumulation will drop on the plate and then onto the floor and not onto the back bar yarn. Also, the machine should be equipped with a moving vacuum system in order to remove and clean the lint build-up from the machine. The spun staple polyester yarn requires proper yarn tension from the sley point to the guide bar in order to minimize liveliness and breakage on the machine.

Figure 1:
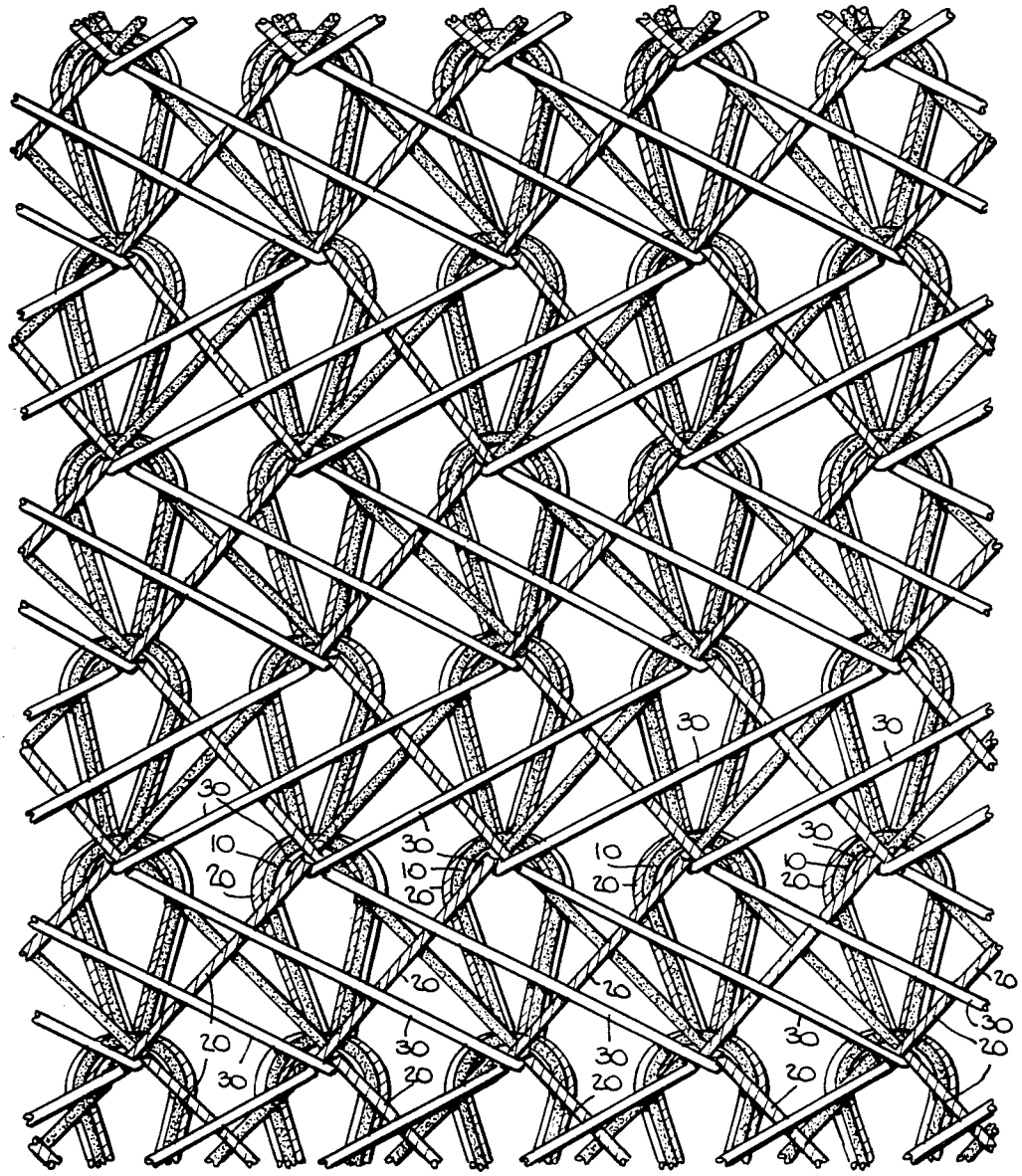
FIG. 1 is a top view of the moldable fabric of the present invention.

FIG. 1 shows a top view of moldable fabric prepared in accordance with the method of the present invention using, in a preferred embodiment, a 3 bar warp knitting machine.

From the preceding description of the preferred embodiment, it is evident that the objects of the invention are attained in that a uniquely prepared spun staple polyester yarn is provided which is capable of being skilled on a warp knitting machine to produce a moldable fabric of increased hand. Although the invention has been described and illustrated in detail concerning a moldable fabric for bar cups, it is to be clearly understood that the same is by way of illustration and example only and is not to be taken by way of limitation. Other intimate apparel which need not be molded such as panties, slips, etc., may also be made using the present invention. Also, non-moldable portions of a brassiere may also be formed from the subject fabric. The spirit and scope of this invention are to be limited only to the terms of the appended claims.

What we claim is:

1. A method of preparing a knitted fabric capable of being molded into a garment having improved hand, said method comprising the steps of:

(a) spinning synthetic stable fibers having a denier of less than 2, a staple length in a range of about 1.5 to about 2 inches, and having a size no coarser than 60 single spun count into spun yarn;

(b) twisting said yarn in a range of 24 to 36 twists per inch;

(c) waxing and steaming said yarn;

(d) warping said yarn in an environment having a humidity in a range of 65% to 70% and having a temperature in a range of 70° to 72° Fahrenheit; and (e) knitting said warped yarn on a 28 guage tricot warp knitting machine.

2. The method according to claim 1, wherein said twisting step (b) includes twisting said yarn in a range of 3.25 to 4.5 twist multipliers.

3. A method of preparing a knitted fabric capable of being molded into a garment having improved hand, said method comprising the steps of:

(a) spinning synthetic stable fibers having a denier of less than 2, a staple length in a range of about 1.5 to about 2 inches, and having a size no coarser than 50 single spun count into spun yarn;

(b) twisting said yarn in a range of 24 to 36 twists per inch;

(c) waxing and steaming said yarn;

(d) warping said yarn in an environment having a humidity in a range of 65% to 70% and having a temperature in a range of 70° to 72° Fahrenheit; and (e) knitting said warped yarn on a Raschel warp knitting machine.

4. The method according to claim 3, wherein said twisting step (b) includes twisting said yarn in a range of 3.25 to 4.5 twist multipliers.

* * * * *